United States Patent [19]

Havel

[11] Patent Number: 4,775,335

[45] Date of Patent: Oct. 4, 1988

[54] ELECTRICAL CONNECTOR

[76] Inventor: Karel Havel, 15 Kensington Road, Apt. #704, Bramalea, Ontario, Canada, L6T 3W2

[21] Appl. No.: 58,160

[22] Filed: Jun. 4, 1987

Related U.S. Application Data

[63] Continuation-in-part of Ser. No. 844,690, Mar. 27, 1986.

[51] Int. Cl.[4] ..... H01R 4/40

[52] U.S. Cl. ..... 439/820; 439/863

[58] Field of Search ..... 439/725, 726, 728, 729, 439/738, 739, 743, 750, 751, 259, 296, 260, 263, 264, 268, 266, 298, 299, 310, 759, 772, 774, 790, 816, 819, 820, 837, 863

[56] References Cited

U.S. PATENT DOCUMENTS

| | | | |
|---|---|---|---|
| 1,165,278 | 12/1915 | Miller | 439/729 |
| 1,678,745 | 7/1928 | Schellenger | 439/266 |
| 4,684,193 | 8/1987 | Havel | 439/263 |

*Primary Examiner*—Joseph H. McGlynn

[57] ABSTRACT

An electrical zero insertion force connector includes a tubular elongated conducting body having an opening at its one end for inserting a conductor and a socket with a plurality of integral gripping jaws resiliently extending into the body and away from the opening. An insulating slider is arranged within the body for reciprocating movement between an engaging position, for deflecting the jaws into intimate electrical contacts with the conductor, and a disengaging position, for releasing the jaws from the conductor. The slider protrudes from an end of the body opposite the opening.

4 Claims, 1 Drawing Sheet

ELECTRICAL CONNECTOR

CROSS-REFERENCE TO RELATED APPLICATIONS

This is a continuation-in-part of my application Ser. No. 06/844,690, filed on Mar. 27, 1986, entitled Electrical Zero Insertion Force Connector, abandoned.

BACKGROUND OF THE INVENTION

1. Field of the Invention

This invention relates to electrical connectors of zero insertion force type.

2. Description of the Prior Art

An electrical connector described in U.S. Pat. No. 1,535,451, issued on Apr. 28, 1925 to Samuel Cohen, utilizes a tapered connector head divided by longitudinal slots into segments. A movable sleeve forces the head segments into electrical engagement with a conductor.

When operating the movable sleeve, which extends on the insertion side, it is possible to accidentally touch the inserted conductor and thereby damage its contacting surfaces.

An electrical connector described in U.S. Pat. No. 3,122,408, issued on Feb. 25, 1964 to Jojne Laszczewski, includes a female section with longitudinally split end supported for longitudinal movement in a static base. Annular groove is formed on the female section and adapted to engage a resilient ring mounted in the base, whereby the female section may be secured in a locking position making contact with a male element which may be inserted from the side of the jaws on the female section.

Connectors with flexible jaws on the insertion side have a problem in that certain of the jaws may be bent or broken by a misaligned inserted conductor.

SUMMARY OF THE INVENTION

It is the principal object of this invention to provide an improved electrical zero insertion force connector which is extremely simple in construction and efficient in operation.

It is another object of the invention to provide an electrical connector in which flexible connector jaws extend away from the insertion side and thus are protected against possible damage by a misaligned inserted conductor.

It is still another object of the invention to provide a safe electrical connector protected from damage by accidental touching to the contact surfaces of inserted conductor.

In summary, an electrical connector of the invention includes a tubular conducting body with an opening at its one end for inserting a conductor from an insertion side and a socket secured to the body and having a plurality of integral resiliently flexible jaws which extend into the body, away from the opening, and away from the insertion side. The jaws may be deflected into intimate electrical contact with a conductor by a tubular insulating slider movable within the body and protruding from an end of the body opposite the opening.

Further objects of the invention will become obvious from the accompanying drawings and their description.

BRIEF DESCRIPTION OF THE DRAWINGS

In the drawings in which is shown the preferred embodiment of the invention.

Throughout the drawings, like characters indicate like parts.

DESCRIPTION OF THE PREFERRED EMBODIMENT

Referring now, more particularly, to the drawings, in FIGS. 1 to 4 are shown various views of an electrical zero insertion force connector of the present invention which includes a socket 10 and conducting pin 21. Generally, the connector has two conditions: engaged one, illustrated in FIGS. 2 and 3, in which socket 10 is in intimate electrical contact with pin 21, and disengaged one, illustrated in FIG. 1, in which pin 21 may be inserted to, or withdrawn from, socket 10. As will be pointed out more specifically below, slider 30 serves to engage and disengage the connector.

Figure 4:
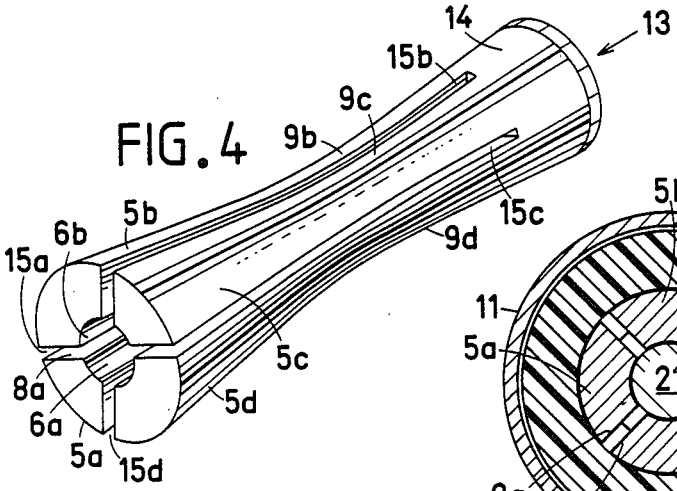
FIG. 4 is a perspective view of a socket 10 of FIG. 1.
Figure 3:
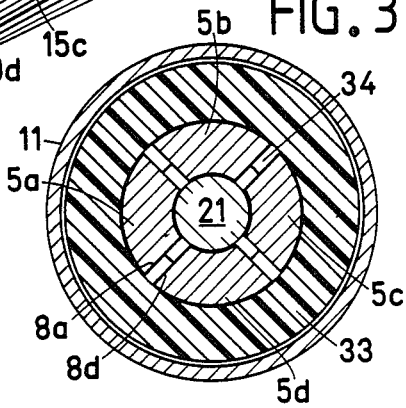
FIG. 3 is a cross-sectional view of a connector of FIG. 2, taken along the line 3—3, showing the detail of engaged connector jaws.
Figure 1:
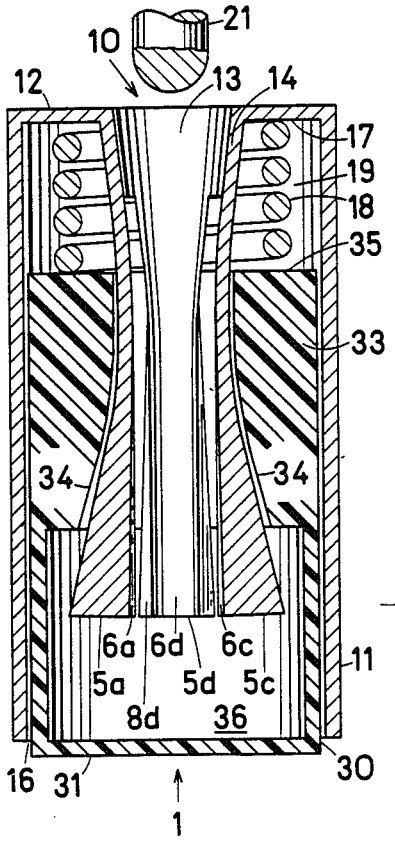
FIG. 1 is a cross-sectional view of a connector of this invention in its disengaged condition.

The invention resides in the female part of the connector which includes a tubular elongated conducting body 11 extending along a vertical axis and having on its top insertion end funneling opening 13, defined by conical wall 14 formed in the top portion 12, for directing a conducting pin 21 into elongated conducting socket generally denoted at 10, and bottom opening 16 for a slider 30. Conducting body 11 is adapted to be soldered in a cylindrical plated-through hole, but alternatively may include an electrical terminal for joining a conductor thereto (not shown). Conducting socket 10, axially secured in body 11, includes four symmetrically disposed gripping jaws **5*a*, 5*b*, 5*c*, and 5*d* integral with conical wall 14 and respectively separated by longitudinal slots 15*a*, 15*b*, 15*c*, and 15*d*. Jaws 5*a*, 5*b*, 5*c*, and 5*d*, having resiliently flexible portions 9*a*, 9*b*, 9*c*, and 9*d*, respectively, extend into body 11, away from opening 13, and away from one another, as illustrated in FIG. 1, so as to form an opening into socket 10 larger than the diameter of pin 21, whereby the latter may be inserted and withdrawn without the necessity to exert any force. Respective jaws 5*a*, 5*b*, 5*c*, and 5*d* are tapered in the thickness and have abutting surfaces 7*a*, 7*b* (not shown but similar to 7*a*), 7*c*, and 7*d* (not shown but similar to 7*c*) formed on their outer convex surfaces and contacting surfaces 6*a*, 6*b*, 6*c*, and 6*d*** formed on their inner concave surfaces.

Figure 2:
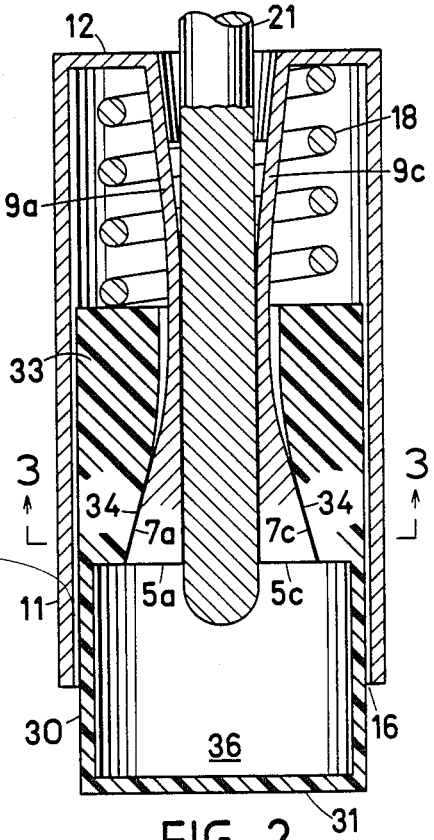
FIG. 2 is a cross-sectional view of a connector of FIG. 1 in its engaged condition.

An insulating tubular slider 30, having a cylindrical body 33 of an external diameter less than the internal diameter of body 11, and having its lower end closed by a bottom 31 which serves as a cover for volume 36, is slidably axially movable inside body 11 in the direction of elongation of socket 10 between an engaging position, viewed in FIG. 2, for deflecting jaws **5*a*, 5*b*, 5*c*, and 5*d* into intimate electrical contacts with pin 21, and a disengaging position, viewed in FIG. 1**, for releasing the jaws from the pin.

An annular spring cavity 19 is defined inside body 11 between the end wall 17 of body 11 and top portion 35 of slider body 33 for accommodating a helical coil spring 18 which surrounds socket 10. Spring 18 is anchored at its one end by top wall 17 and has its other end applied to top end 35 of slider 30 for urging it to its engaging position wherein its bottom 31 protrudes from lower open end 16 of body 11, as shown in FIG. 2.

Slider 30 has annular abutting surfaces 34 formed on its body 33 and adapted to engage like abutting surfaces *7a, 7b, 7c,* and *7d* on respective jaws *5a, 5b, 5c,* and *5d.* When in its engaging position, slider 30 abuts jaws *5a, 5b, 5c,* and *5d,* as illustrated in FIG. 2, to deflect same for capturing pin 21 and for bringing contacting surfaces formed thereon into intimate electrical contact with contacting surfaces *6a, 6b, 6c,* and *6d* on the jaws which are formed to closely conform to the shape of pin 21. Opposed gripping forces are applied to the contacting surfaces resulting in a reliable contact along a relatively large contacting area.

Since jaws *5a, 5b, 5c,* and *5d* extend into body 11, away from opening 13, and away from the insertion end, they are protected from accidental damage by a misaligned inserted pin 21.

When in its disengaging position, slider 30 disengages jaws *5a, 5b, 5c,* and *5d* for releasing pin 21. Consequently, to insert or withdraw pin 21, it is necessary to manually push slider 30 away from its engaging position, against the force of spring 18, into body 11 to its extreme inward position, as indicated in FIG. 1 by arrow 1. When pin 21 is inserted from the insertion end defined by guiding funneling opening 13, slider 30 may be released to assume, urged by spring 18, its engaging position shown in FIG. 2.

Since slider 30 is operated from the bottom side of the connector, opposite opening 13 for pin 21, the accidental touching of, and possible damage to the contacting surfaces on, pin 21 may be readily prevented.

Jaws *5a, 5b, 5c,* and *5d* are also provided with abutting surfaces therebetween, such are abutting surfaces *8a* and *8d,* which serve to limit the deflection of the jaws when no pin is inserted, to thereby limit the travel of slider 30 and prevent it from leaving socket 10. In such a case, the deflected jaws form an opening of a diameter slightly less than that shown in FIG. 4. It is contemplated that socket 10 may be provided with any suitable number of jaws which do not need to be symmetrical.

In summary, the invention describes a socket-type electrical connector including a tubular conducting body having opposite open ends. An elongated conducting socket, having an opening aligned with one of the open ends for inserting a conductor from an insertion side, is secured in the body and includes a plurality of flexible conducting elements extending into the body, away from the opening, and away from the insertion side. A cylindrical insulating slider is arranged on the socket and within the body for reciprocating movement in the direction of elongation of the socket between an engaging position, for deflecting the conducting elements into intimate electrical contacts with the conductor, and a disengaging position, for releasing the conducting elements from the conductor.

It would be appreciated by those skilled in the art that modifications can be made in the construction of the preferred embodiment shown herein without departing from the spirit and scope of the invention as defined in the appended claims.

What I claim is:

1. An electrical connector comprising:

an elongated conducting socket having an opening for inserting a conductor from an insertion side and including a plurality of integral flexible conducting elements extending away from said opening and away from said insertion side; and a slider member arranged on said socket for reciprocating movement in the direction of elongation of said socket between an engaging position, for deflecting said conducting elements into intimate electrical contacts with said conductor, and a disengaging position, for releasing said conducting elements from said conductor.

2. An electrical connector comprising:

a tubular electrically conducting body having an open end and an opposite end;

an elongated electrically conducting socket integral with said body, having an opening aligned with said open end for inserting a conductor, and including a plurality of integral flexible electrically conducting elements extending into said body and away from said opening toward said opposite end; and a slider member arranged on said socket and within said body for reciprocating movement in the direction of elongation of said socket between an engaging position, for deflecting said conducting elements into intimate electrical contacts with said conductor, and a disengaging position, for releasing said conducting elements from said conductor.

3. An electrical connector comprising:

a tubular electrically conducting body having a longitudinal axis and opposite first open end and second open end;

an elongated electrically conducting socket integral with, and axially secured in, said body, said socket having an opening aligned with said first open end for inserting a conductor and including a plurality of integral flexible electrically conducting elements extending into said body and away from said opening toward said second open end;

a slider member arranged on said socket and within said body for reciprocating axial movement in the direction of elongation of said socket between an engaging position, for deflecting said conducting elements into intimate electrical contacts with said conductor, and a disengaging position, for releasing said conducting elements from said conductor;

said slider member extending beyond said second open end.

4. An electrical connector as defined in claim 3 wherein said slider member is tubular and has its portion that extends beyond said second open end closed.

* * * * *